US008773262B2

(12) United States Patent
Bae et al.

(10) Patent No.: US 8,773,262 B2
(45) Date of Patent: Jul. 8, 2014

(54) CONTAINER SECURITY APPARATUS

(76) Inventors: Moon Jun Bae, Busan (KR); Hyung Rim Choi, Busan (KR); Chul Young Bae, Busan (KR); Hyun Il Cho, Gyeonggi-do (KR); Jae Joong Kim, Busan (KR); Jae Kee Lee, Busan (KR); Soon Goo Hong, Busan (KR); Chae Soo Kim, Busan (KR); Gwang Hoon Kwark, Busan (KR); Kangbae Lee, Busan (KR); Eun Kyu Lee, Busan (KR); Joong Jo Shin, Busan (KR); Jung Rock Son, Busan (KR); Young Sik Moon, Busan (KR); Moo Hong Kang, Busan (KR); Sung Pill Choi, Busan (KR)

( * ) Notice: Subject to any disclaimer, the term of this patent is extended or adjusted under 35 U.S.C. 154(b) by 0 days.

(21) Appl. No.: 13/583,876

(22) PCT Filed: Mar. 7, 2011

(86) PCT No.: PCT/KR2011/001547
§ 371 (c)(1),
(2), (4) Date: Sep. 10, 2012

(87) PCT Pub. No.: WO2011/111959
PCT Pub. Date: Sep. 15, 2011

(65) Prior Publication Data

US 2013/0000362 A1 Jan. 3, 2013

(30) Foreign Application Priority Data

Mar. 11, 2010 (KR) ..... 10-2010-0021720

(51) Int. Cl.
*E05B 45/06* (2006.01)

(52) U.S. Cl.
USPC ..... 340/542; 340/540

(58) Field of Classification Search
USPC ..... 340/542, 540
See application file for complete search history.

(56) References Cited

U.S. PATENT DOCUMENTS

2008/0309487 A1* 12/2008 Chao ..... 340/542
2010/0013635 A1* 1/2010 Berger et al. ..... 340/542
2010/0194579 A1* 8/2010 Choi et al. ..... 340/686.6

FOREIGN PATENT DOCUMENTS

KR 10-2007-0114483 A 12/2007
KR 10-2007-0120134 A 12/2007

OTHER PUBLICATIONS

PCT International Search Report dated Oct. 21, 2011 for PCT/KR2011/001547 from which the instant application is based.

* cited by examiner

*Primary Examiner* — Travis Hunnings
(74) *Attorney, Agent, or Firm* — Fredrikson & Byron, PA

(57) ABSTRACT

The present invention relates to a container security apparatus which is easily attachable/detachable to/from both opening/closing bars of a container to sense whether the container is opened/closed and transmit the sensed information on whether the container is opened/closed to a remote location, to thereby check whether the container is sealed or not on a real time basis and thus safely transport the container, and to thereby check the current position of the container in transit and check whether or not the container has deviated from a predetermined path on a real time basis.

21 Claims, 11 Drawing Sheets

CONTAINER SECURITY APPARATUS

RELATED APPLICATIONS

This application is a 35 U.S.C. 371 national stage filing from International Application No. PCT/KR2011/001547 filed Mar. 7, 2011 and claims priority to Korean Patent Application No. 10-2010-0021720, filed on Mar. 11, 2010, the teachings of which are incorporated herein by reference.

TECHNICAL FIELD

The present invention relates to a container security apparatus, and more particularly, to a container security apparatus for safely transporting a container.

BACKGROUND ART

Generally, containers are widely used as means for shipping goods. Particularly, when transporting goods by land from a harbor to an airport, goods are loaded in containers and transported using vehicles.

Such containers are left as they are in a harbor that is a starting point for a long period or are transported for a long time to a destination in a state of transporting via vehicles. In this case, there occur many robbery cases of goods loaded in containers.

Robbery cases as described above frequently occur due to structural defects of container security apparatuses. Though there occurs a robbery case, it is hard to be found, which is more fatal.

General containers include door latch mechanism to lock a door thereof.

Generally used door latch mechanisms have a problem of being easily opened by drilling bolts of a latch attached to the door. A seal itself may be unsealed using a general cutting device or it is easy to take the seal to pieces by using a duplication thereof.

On the other hand, electronic seal (eSeal) recently provided is similar to general door seals, identical to door latch mechanisms as a component of a container, and very easily cut off or damaged similar to door latch mechanisms, which makes it impossible to provide safe transportation of containers.

DISCLOSURE

Technical Aspect

An aspect of the present invention provides a container security apparatus attached to both opening/closing bars of a container to be detachable to sense whether the container is opened or not and transmitting the sensed opening/closing information to a remote location to check in real time whether the container is sealed or not, thereby safely transporting the container.

An aspect of the present invention also provides a container security apparatus capable of checking a present location of a container and checking a case when a container deviates from the designated path in real time.

Technical Solution

According to an aspect of the present invention, there is provided a container security apparatus including: a main cover unit with a display part displaying a present state; a main frame coupled with the main cover unit internally, including a first insertion part surrounding one of both opening/closing bars of a container, formed on one side thereof; a first body unit coupled with the main frame internally, including a power-supply part with a built-in battery for supplying power stably mounted thereon; and a sensing part including a guide groove formed penetrating thereinside, a plurality of coupling holes connected to the guide groove, into which a coupling element is inserted, and a sealing sensor whose one end is connected to the coupling element, sensing whether the container is opened or not; a second body unit coupled with the first body unit internally, including an antenna part with a built-in antenna stably mounted thereon; and a board part with a board stably mounted thereon, the board including a sealing module electrically connected to another end of the sealing sensor and transmitting the opening/closing information of the container according to a sensing signal of the sealing sensor, a global positioning system (GPS) module sensing a present location of the container in real-time and transmitting the location information, a communication module transmitting the opening/closing information and the location information to an administration server in real-time, and a control module transmitting the opening/closing information and the location information to the communication module and controlling the sealing module, the GPS module, and the communication module; and a lock frame including a second insertion part surrounding another opening/closing bar of the container and fastened thereto, flat plates connected to both ends of the second insertion part in a single body, a detachable plate connected to one of the flat plates in a single body, with a plurality of detachable holes formed thereon corresponding to the coupling holes, and slidably inserted into the guide groove of the sensing part and coupled with the sensing part by a coupling element, and wire whose one end is connected to an input detachable hole of the detachable holes and other end is connected to an output detachable hole thereof, wherein sealing maintenance information is transmitted when a current circulating the lock frame is input/output to/from the sealing module electrically connected to the sealing sensor, and wherein release information is transmitted when the lock frame is cut off and there is no current running therethrough.

Also, the lock frame may include a wire line formed thereinside, where the wire is inserted in and fastened thereto.

Also, the lock frame may include a wire groove formed thereinside, where the wire passes through and is fastened thereto.

Also, the lock frame may be formed of stainless steel.

Also, the flat plates may include: a first flat plate connected between one end of the second insertion part and the detachable plate in a single body; and a second flat plate connected to another end of the second insertion part in a single body, wherein the wire is continuously formed from the detachable plate to the second flat plate.

Also, on inner circumferential surfaces of the input detachable hole and the output detachable hole, there may be provided conductive elements, respectively, electrically connected to the coupling element.

Also, the communication module may be formed of one of code division multiple access (CDMA), wideband code division multiple access (WCDMA), wireless broadband Internet (WiBro), wireless fidelity (WiFi), and global system/standard for mobile communication (GSM) module.

Also, the board may further include a database (DB) module for storing container information such as a transfer path, a number, and a license plate number of the container.

Also, the board may further include a warning module generating and transmitting an alarm signal when the container is deviated from a transfer path thereof or sealing of the container is illegally released.

Also, the apparatus may further include, when the alarm signal is generated, function of resetting data stored when illegally opening the container, arbitrarily operating the container, or turning off the power of the container.

Also, the warning module may generate and transmit the alarm signal when a present charge capacity of the built-in battery is 25% or less of a maximum charge capacity thereof.

Also, the insertion part may include: a sub frame connected to one end of the main frame in a single body and surrounding the opening/closing bar; a compression controller including a shaft whose both ends are fastened to the sub frame externally, a compression cam rotation on an axis of the shaft, and an opening/closing handle connected to the compression cam in a single body; a tightening element installed inside the sub frame and transferred toward the opening/closing bar by a pressure applied by the compression cam; a spring section installed on both sides of the shaft and connected from the outside of the sub frame to a top of the tightening element; and a buffering element installed inside between the tightening element and the sub frame and relieving an impact with the opening/closing bar and improving a grip force.

Also, the spring section may include: a plurality of vertical supporters whose one end is vertically connected to the tightening element; a plurality of springs provided surrounding the outside of the vertical supporters; and a spring stopper provided on other ends of the vertical supporters and connecting the plurality of vertical supporters.

Also, inside the second insertion part, there may be provided a buffering element relieving an impact with the opening/closing bar and improving a grip force.

Also, the buffering element may be formed of a material capable of improving the grip force by strengthening a frictional force such as rubber.

Also, the power-supply part may include a power-supply switch formed on one side thereof, the power-supply switch turned on when the lock frame is coupled with the sensing part and turned off when the lock frame is detached from the sensing part.

Also, the power-supply part may turn on the power when the lock frame is coupled with the sensing part and the opening/closing handle is pressurized and may turn off the power when the lock frame is detached from the sensing part and the opening/closing handle is relieved.

Also, the power-supply part may include a battery port for electrically charging the built-in battery.

Also, the coupling element may be formed of one of a pin, a bolt, and a switch.

Also, the display part may display a state whether the power is turned on or off, a state of a residual amount of the battery, a communication state, and a sealed state.

Also, the main cover unit may include a sub cover part covering the coupling element and preventing malfunction of the coupling element.

Advantageous Effects

As described above, the container security apparatus according to an embodiment of the present invention provides an effect of safely transporting the container by easily attaching/detaching the apparatus to/from both opening/closing bars of a container, sensing whether the container is opened or not, transmitting opening/closing information to a remote location, and checking whether the container is sealed or not in real-time.

Also, the apparatus provides an effect of checking in real-time a location of the container and whether the container is deviated from a transfer path thereof.

Also, the apparatus provides an effect of being applied to not only container vehicles but also various vehicles transferred maintaining security thereof such as refrigerator vehicles.

BRIEF DESCRIPTIONS OF THE DRAWINGS

DESCRIPTION ON REFERENCE NUMERALS RELATED TO PRIMARY PARTS

Figure 1:
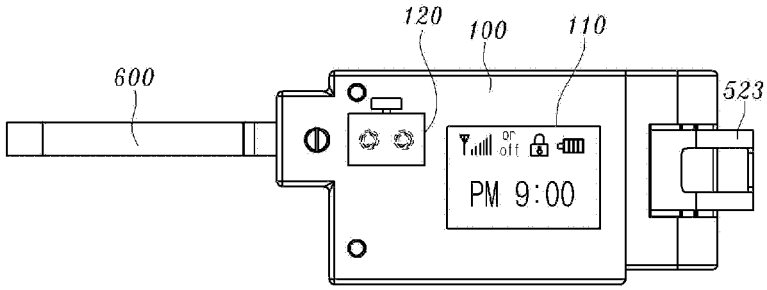
FIG. 1 is a front view illustrating a container security apparatus according to an embodiment of the present invention.

100: MAIN COVER UNIT
110: DISPLAY PART
120: SUB COVER PART
200: MAIN FRAME
300: FIRST BODY UNIT
310: POWER-SUPPLY PART
311: BUILT-IN BATTERY
312: POWER-SUPPLY SWITCH
320: SENSING PART
321: GUIDE GROOVE
322: COUPLING HOLE
323: COUPLING ELEMENT
324: SEALING SENSOR
400: SECOND BODY UNIT
410: ANTENNA PART
420: BOARD PART
430: BOARD
431: SEALING MODULE
432: GPS MODULE
433: COMMUNICATION MODULE
434: DB MODULE
435: WARNING MODULE
436: CONTROL MODULE
500: FIRST INSERTION PART
510: SUB FRAME
520: COMPRESSION CONTROLLER
521: SHAFT
522: COMPRESSION CAM
523: OPENING/CLOSING HANDLE
530: TIGHTENING ELEMENT
540: SPRING SECTION
541: VERTICAL SUPPORTER
542: SPRING STOPPER
543: SPRING
550 & 611: BUFFERING ELEMENTS
600: LOCK FRAME
610: SECOND INSERTION PART
620: FLAT PLATE
621: FIRST FLAT PLATE
622: SECOND FLAT PLATE
630: DETACHABLE PLATE
631: DETACHABLE HOLE
**631*a***: INPUT DETACHABLE HOLE
**631*b***: OUTPUT DETACHABLE HOLE
632: CONDUCTIVE ELEMENT
640: WIRE
700: OPENING/CLOSING BAR

BEST MODE

Hereinafter, exemplary embodiments of the present invention will now be described in detail with reference to the attached drawings. It should be noted that the same elements or components have the same reference numerals. While describing the present invention, a detailed description on well-known art or configurations will be omitted not to make the substance of the present invention equivocal.

Figure 2:
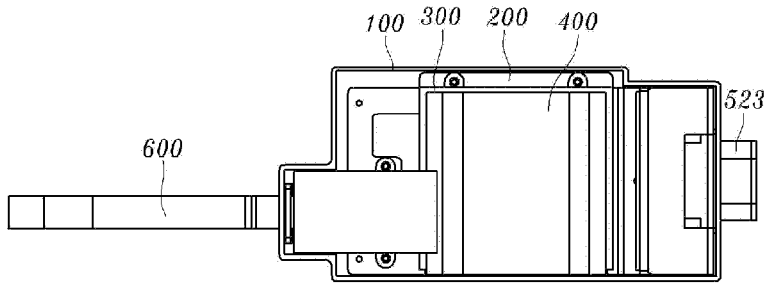
FIG. 2 is a rear view illustrating the container security apparatus of FIG. 1.
Figure 3:
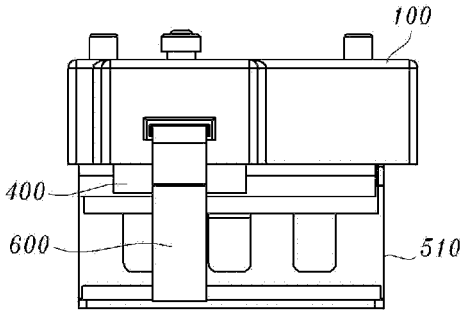
FIG. 3 is a left-side view illustrating the container security apparatus of FIG. 1.
Figure 4:
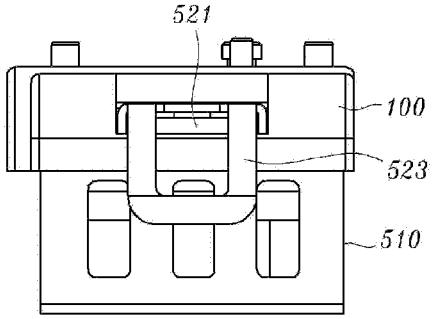
FIG. 4 is a right-side view illustrating the container security apparatus of FIG. 1.
Figure 5:
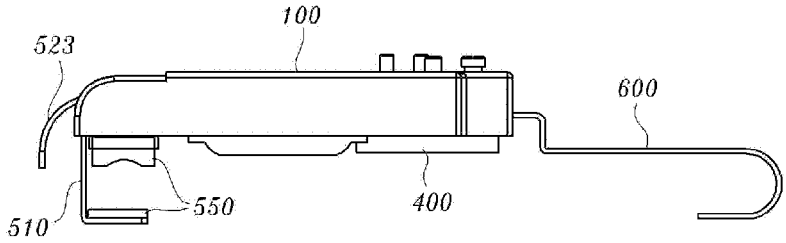
FIG. 5 is a top view illustrating the container security apparatus of FIG. 1.
Figure 6:
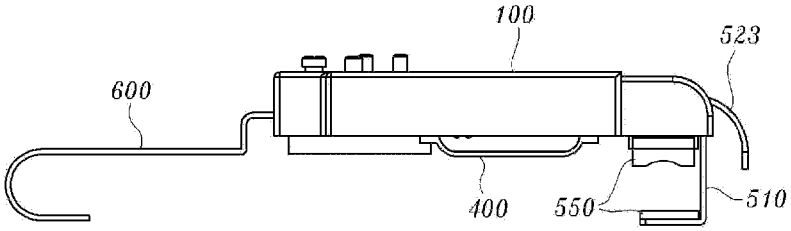
FIG. 6 is a bottom view illustrating the container security apparatus of FIG. 1.
Figure 7:
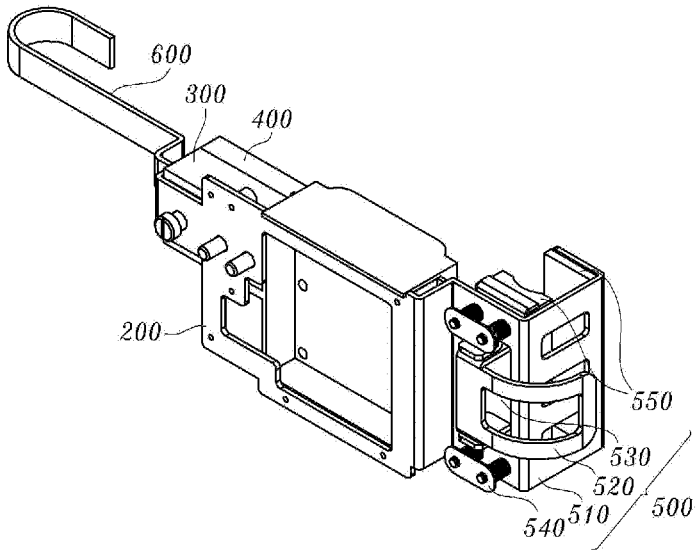
FIG. 7 is a schematic perspective view illustrating the container security apparatus of FIG. 1.

FIG. 1 is a front view illustrating a container security apparatus according to an embodiment of the present invention; FIG. 2 is a rear view illustrating the container security apparatus of FIG. 1; and FIG. 3 is a left-side view illustrating the container security apparatus of FIG. 1. Also, FIG. 4 is a right-side view illustrating the container security apparatus of FIG. 1; FIG. 5 is a top view illustrating the container security apparatus of FIG. 1; and FIG. 6 is a bottom view illustrating the container security apparatus of FIG. 1. In addition, FIG. 7 is a schematic perspective view illustrating the container security apparatus of FIG. 1;

The container security apparatus includes, as shown in FIGS. 1 to 7, a main cover unit 100, a main frame 200, a first body unit 300, a second body unit 400, and a lock frame 600.

Figure 8:
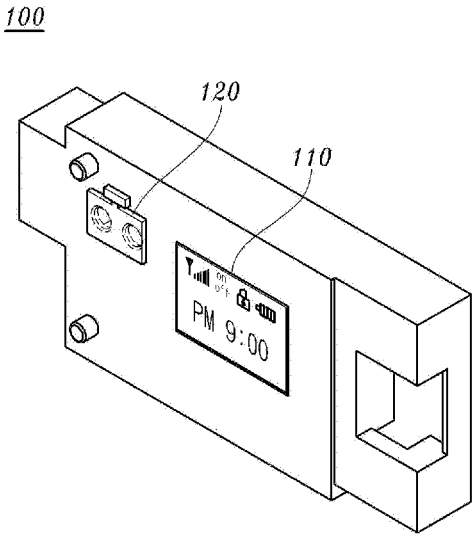
FIG. 8 is a configuration view illustrating a main cover unit of the container security apparatus according to an embodiment of the present invention.

FIG. 8 is a configuration view illustrating the main cover unit 100 of the container security apparatus according to an embodiment of the present invention.

Referring to FIGS. 1 to 6 and 8, the main cover unit 100 is coupled with the main frame 200 externally, covers the main frame 200 and a first insertion part 500 that will be described later, and includes a display part 110 and a sub cover part 120. The display part 110 displays a present state of the container security apparatus.

The sub cover part 120 covers a coupling element 323 passing through and coupled with the main cover unit 100, which will be described later, and prevents the malfunction of the coupling element 323.

Figure 9:
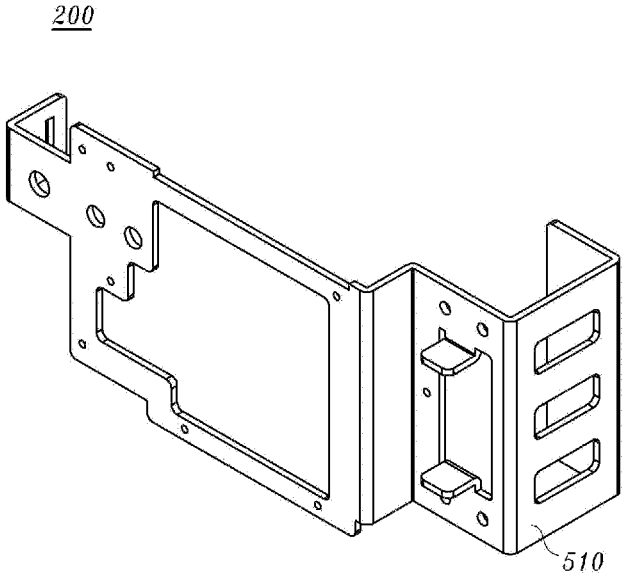
FIG. 9 is a configuration view illustrating a main frame of the container security apparatus according to an embodiment of the present invention.

FIG. 9 is a configuration view illustrating the main frame 200 of the container security apparatus according to an embodiment of the present invention.

Referring to FIGS. 7 and 9, the main frame 200 is coupled with the main cover unit 100 internally and equipped with the first insertion part 500 covering and fastened to one of both opening/closing bars of a container on one side thereof.

Figure 18:
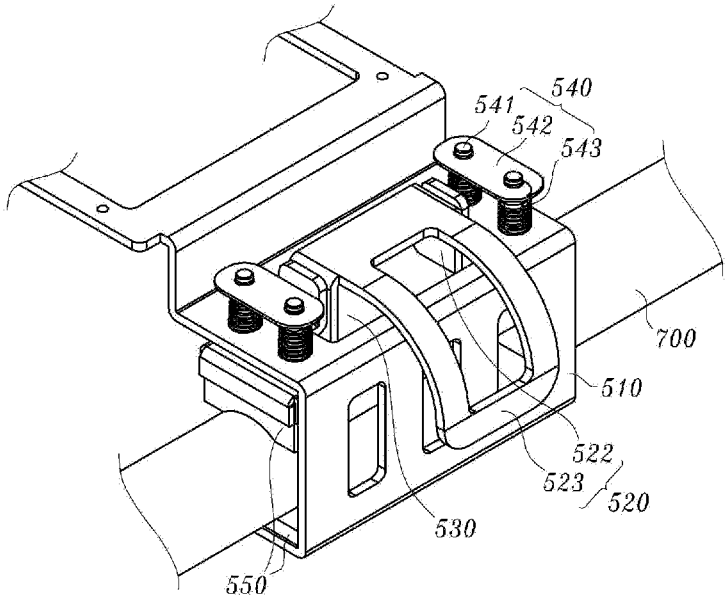
FIG. 18 is a view illustrating an opening/closing bar fastened to the first insertion part according to an embodiment of the present invention.
Figure 19:
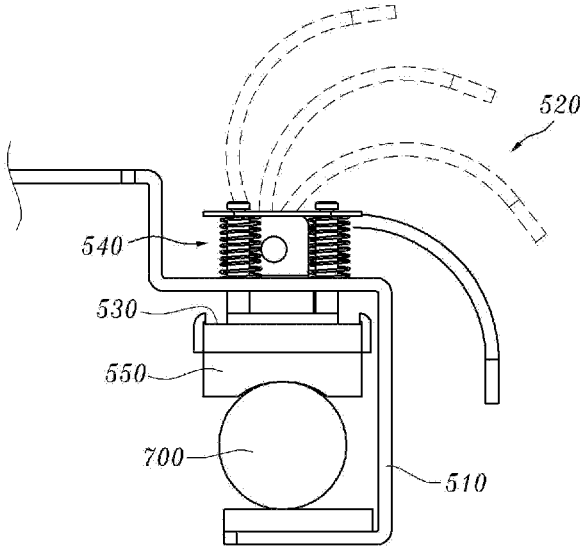
FIG. 19 is a view illustrating an operation of fastening the opening/closing bar to the first insertion part according to the present invention.

FIG. 18 is a view illustrating the opening/closing bar 700 fastened to the first insertion part 500 according to an embodiment of the present invention, and FIG. 19 is a view illustrating an operation of fastening the opening/closing bar 700 to the first insertion part 500 according to the present invention.

Referring to FIGS. 18 and 19, the first insertion part 500 includes a sub frame 510, a compression controller 520, a tightening element 530, a spring section 540, and a buffering element 550.

The sub frame 510 is connected to one side of the main frame 200 in a single body and may surround and support the opening/closing bar 700 externally.

The compression controller 520 may perform one of fastening the opening/closing bar 700 to the first insertion part 500 and separating the opening/closing bar 700 from the first insertion part 500, as shown in FIGS. 4 and 18, may include a shaft 521, a compression cam 522, and an opening/closing handle 523.

The tightening element 530 is installed inside the sub frame 510 and transfers toward the opening/closing bar 700 due to a pressure of the compression cam 520, and may be closely attached to the opening/closing bar 700.

Referring to FIG. 18, the spring section 540 is installed on both sides of the shaft 521, may be connected from the outside of the sub frame 510 to a top of the tightening element 530, and may restore the tightening element 530 to an original location thereof when the opening/closing handle 523 is rotationally transferred from a bottom to a top to release the pressure of the compression cam 522 toward the tightening element 530.

The buffering element 550 is provided inside between the tightening element 530 and the sub frame 510 to buffer an impact between the tightening element 530 and the opening/closing bar 700 and may improve grip thereof.

Figure 10:
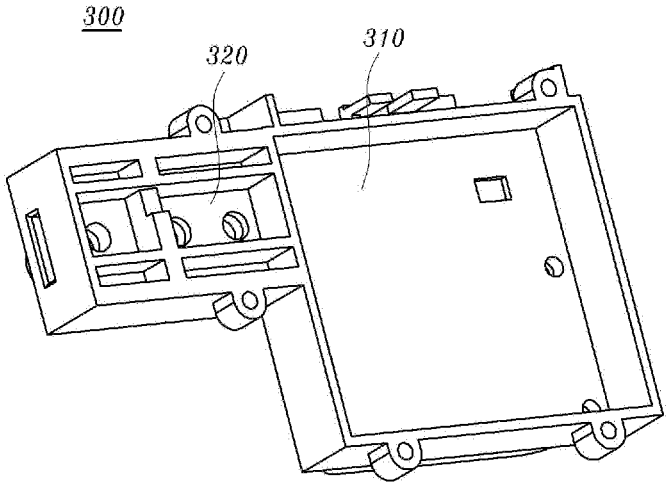
FIG. 10 is a configuration view illustrating a first body unit of the container security apparatus according to an embodiment of the present invention.
Figure 21:
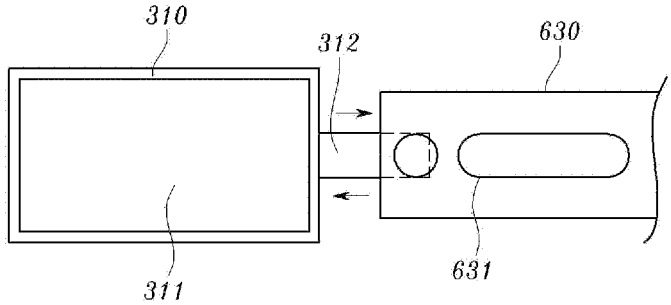
FIG. 21 is a view illustrating an operation of turning on or off a power-supply switch according to an embodiment of the present invention.

FIG. 10 is a configuration view illustrating the first body unit 300 of the container security apparatus according to an embodiment of the present invention, and FIG. 21 is a view illustrating an operation of turning on or off a power-supply switch 312 according to an embodiment of the present invention.

The first body unit 300 is coupled with the main frame 200 internally and includes, as shown in FIG. 10, a power-supply part 310 and a sensing part 320.

Referring to FIG. 21, the power-supply part 310 includes a built-in battery 311 stably mounted thereon to apply power and the power-supply switch 312 turned on when the lock frame 600 is coupled with the sensing part 320 and turned off when the lock frame 600 is detached from the sensing part 320 and simultaneously, the compression of the opening/closing handle 523 is released to separate the opening/closing bar 700 from the first insertion part 500.

Figure 14:
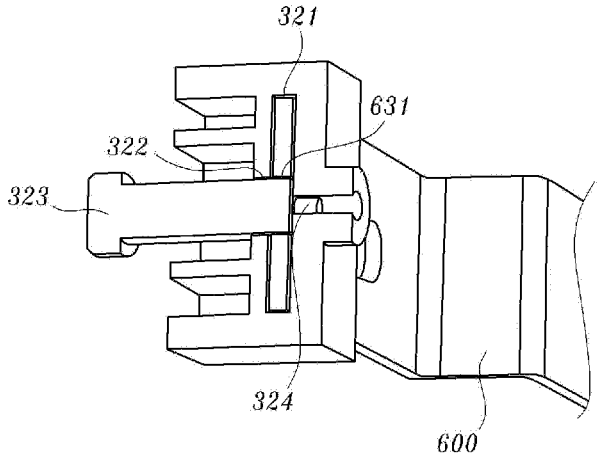
FIG. 14 is a cross-sectional view illustrating the lock frame coupled with a sensing part according to an embodiment of the present invention.

FIG. 14 is a cross-sectional view illustrating the lock frame 600 coupled with the sensing part 320 according to an embodiment of the present invention. The sensing part 320 includes, as shown in FIG. 14, a guide groove 321, a plurality of coupling holes 322, and a sealing sensor 324.

Figure 11:
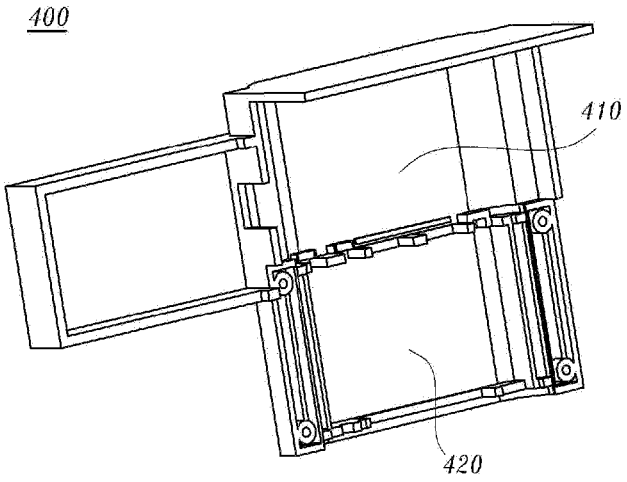
FIG. 11 is a configuration view illustrating a second body unit of the container security apparatus according to an embodiment of the present invention.

FIG. 11 is a configuration view illustrating the second body unit 400 of the container security apparatus according to an embodiment of the present invention.

The second body unit 400 is coupled with the first body unit 300 internally and includes, as shown in FIG. 11, an antenna part 410 and a board part 420.

The antenna part 410 includes a built-in antenna stably mounted thereon.

Figure 16:
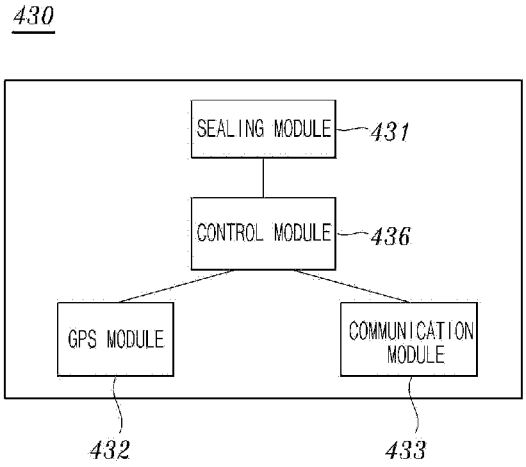
FIGS. 16 and 17 are block views illustrating a board according to an embodiment of the present invention.
Figure 17:
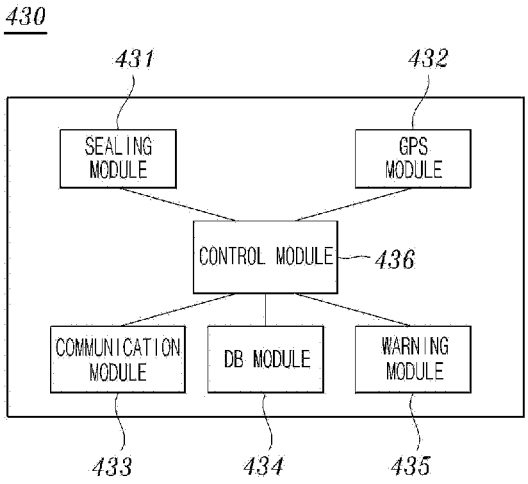

FIGS. 16 and 17 are block views illustrating a board 430 according to an embodiment of the present invention.

The board part 420 includes the board 430 stably mounted thereon, and the board 430 includes, as shown in FIG. 16, a sealing module 431, a global positioning system (GPS) module 432, a communication module 433, and a control module 436.

Figure 12:
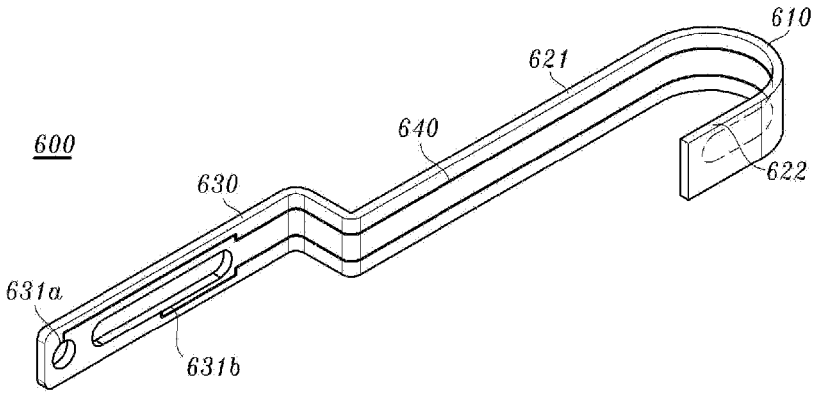
FIGS. 12 and 13 are configuration views illustrating a lock frame of the container security apparatus according to an embodiment of the present invention.
Figure 13:
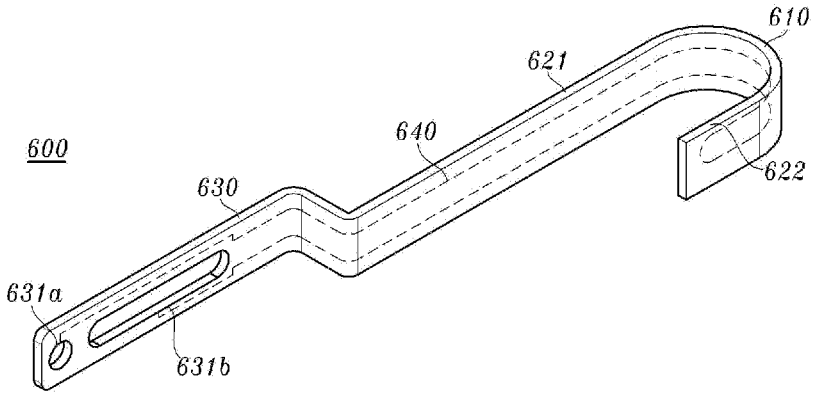

FIGS. 12 and 13 are configuration views illustrating the lock frame 600 of the container security apparatus according to an embodiment of the present invention.

The lock frame 600 may be formed of stainless steel and includes, as shown in FIGS. 12 and 13, a second insertion part 610, flat plates 620, a detachable plate 630, and a wire 640.

Figure 20:
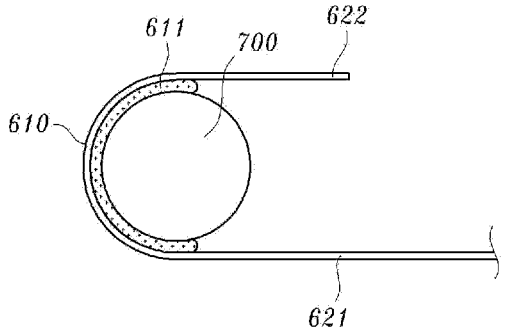
FIG. 20 is a view illustrating the opening/closing bar fastened to the second insertion part according to an embodiment of the present invention.

FIG. 20 is a view illustrating the opening/closing bar 700 fastened to the second insertion part 610 according to an embodiment of the present invention.

The second insertion part 610 surrounds another opening/closing bar 700 of the container and is fastened thereto as shown in FIG. 20.

The flat plate is, as shown in FIGS. 12 and 13, connected to both ends of the second insertion part 610 in a single body.

Figure 15:
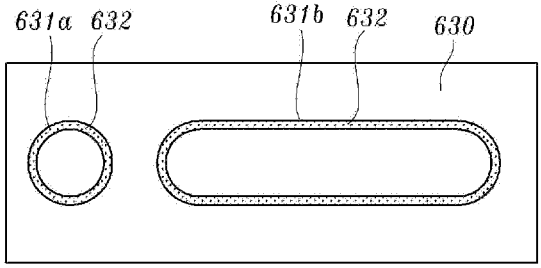
FIG. 15 is a partial top view illustrating a detachable plate according to an embodiment of the present invention.

FIG. 15 is a partial top view illustrating the detachable plate 630 according to an embodiment of the present invention.

The detachable plate 630 is, as shown in FIG. 15, connected to one of two flat plates 620, for example, a first flat plate 621 and includes a plurality of detachable holes 631 corresponding to coupling holes 322.

The detachable plate 630 is slidably inserted into the guide groove 321 in such a way that the detachable hole 631 corresponds to a location of the coupling hole 322 and is coupled with the sensing part 320 by the coupling element 323.

The wire 640 includes, as shown in FIGS. 12 and 13, one end connected an input detachable hole 631*a* and another end connected to an output detachable hole 631*b* and is provided from the detachable plate 630 to the second flat plate 622.

MODE FOR INVENTION

Hereinafter, exemplary embodiments of the present invention will now be described in detail with reference to the attached drawings. It should be noted that the same elements or components have the same reference numerals. While describing the present invention, a detailed description on well-known art or configurations will be omitted not to make the substance of the present invention equivocal.

FIG. 1 is a front view illustrating a container security apparatus according to an embodiment of the present invention; FIG. 2 is a rear view illustrating the container security apparatus of FIG. 1; and FIG. 3 is a left-side view illustrating the container security apparatus of FIG. 1. Also, FIG. 4 is a right-side view illustrating the container security apparatus of FIG. 1; FIG. 5 is a top view illustrating the container security apparatus of FIG. 1; and FIG. 6 is a bottom view illustrating the container security apparatus of FIG. 1. In addition, FIG. 7 is a schematic perspective view illustrating the container security apparatus of FIG. 1;

The container security apparatus includes, as shown in FIGS. 1 to 7, a main cover unit 100, a main frame 200, a first body unit 300, a second body unit 400, and a lock frame 600.

FIG. 8 is a configuration view illustrating the main cover unit 100 of the container security apparatus according to an embodiment of the present invention.

Referring to FIGS. 1 to 6 and 8, the main cover unit 100 is coupled with the main frame 200 externally, covers the main frame 200 and a first insertion part 500 that will be described later, and includes a display part 110 and a sub cover part 120. The display part 110 displays a present state of the container security apparatus.

In detail, the display part 110 may be formed of one of a liquid crystal display (LCD) and a light-emitting diode (LED) and may display the present status of the container security apparatus such as the status of turning the container security apparatus on/off, the status of a residual quantity of a battery, a status of communication, and a status of sealing.

The sub cover part 120 covers a coupling element 323 passing through and coupled with the main cover unit 100, which will be described later, and prevents the malfunction of the coupling element 323.

In detail, the sub cover part 120 may open or shut the coupling element 323 by slidably transferring on the main cover unit 100 or by using a hinge.

FIG. 9 is a configuration view illustrating the main frame 200 of the container security apparatus according to an embodiment of the present invention.

Referring to FIGS. 7 and 9, the main frame 200 is coupled with the main cover unit 100 internally and equipped with the first insertion part 500 covering and fastened to one of both opening/closing bars of a container on one side thereof.

FIG. 18 is a view illustrating the opening/closing bar 700 fastened to the first insertion part 500 according to an embodiment of the present invention, and FIG. 19 is a view illustrating an operation of fastening the opening/closing bar 700 to the first insertion part 500 according to the present invention.

Referring to FIGS. 18 and 19, the first insertion part 500 includes a sub frame 510, a compression controller 520, a tightening element 530, a spring section 540, and a buffering element 550.

The sub frame 510 is connected to one side of the main frame 200 in a single body and may surround and support the opening/closing bar 700 externally.

The sub frame 510 may be formed in various shapes, and more particularly, a shape of "ㄷ" in the present embodiment.

The compression controller 520 may perform one of fastening the opening/closing bar 700 to the first insertion part 500 and separating the opening/closing bar 700 from the first insertion part 500, as shown in FIGS. 4 and 18, may include a shaft 521, a compression cam 522, and an opening/closing handle 523.

The shaft 521 passes through a hollow portion of the compression cam 522 and both ends thereof are fastened to the outside of the sub frame 510.

The compression cam 522 is formed in a rectangular shape whose one set of sides are longer than another set of sides and is rotationally transferred on an axis of the shaft 521.

The opening/closing handle 523 is formed in a parabolic shape with a fluent curve portion formed thereon and is connected to the compression cam 522 in a single body, thereby transferring a rotational force to the compression cam 522.

In detail, as shown in FIG. 19, the opening/closing handle 523 is rotationally transferred from a top to a bottom in such a way that the compression cam 522 simultaneously rotates on an axis of the shaft 521 and the tightening element 530 is compressed.

The tightening element 530 is installed inside the sub frame 510 and transfers toward the opening/closing bar 700 due to a pressure of the compression cam 520, and may be closely attached to the opening/closing bar 700.

Referring to FIG. 18, the spring section 540 is installed on both sides of the shaft 521, may be connected from the outside of the sub frame 510 to a top of the tightening element 530, and may restore the tightening element 530 to an original location thereof when the opening/closing handle 523 is rotationally transferred from a bottom to a top to release the pressure of the compression cam 522 toward the tightening element 530.

In detail, the spring section 540 includes, as shown in FIG. 18, a plurality of vertical supporters 541, a plurality of springs 543, and a spring stopper 542.

The vertical supporter 541 includes one end connected vertically to the tightening element 530 and another end projected outside the sub frame 510, thereby supporting the tightening element 530.

The spring 543 is provided surrounding the outside of the vertical supporter 541 and may generate a restoring force to the tightening element 530 depending on contraction and relaxation thereof.

The spring stopper 542 may be provided to the other ends of the vertical supporters 541 to connect the plurality of vertical supporters 541 to one another and may generate an elasticity force to the spring 543 by contracting the spring 543 when the compression cam 522 compresses the tightening element 530.

The buffering element 550 is provided inside between the tightening element 530 and the sub frame 510 to buffer an impact between the tightening element 530 and the opening/closing bar 700 and may improve grip thereof.

In detail, the opening/closing bar 700 is closely attached and fastened to the buffering element 550 transferred by the compression controller 520, whose impact is relieved by the buffering element 550 provided inside between the tightening element 530 and the sub frame 510, thereby being fastened while improving grip thereof. In this case, the buffering element 550 may be formed of a material capable of improving a grip force by strengthening a frictional force such as rubber.

FIG. 10 is a configuration view illustrating the first body unit 300 of the container security apparatus according to an embodiment of the present invention, and FIG. 21 is a view illustrating an operation of turning on or off a power-supply switch 312 according to an embodiment of the present invention.

The first body unit 300 is coupled with the main frame 200 internally and includes, as shown in FIG. 10, a power-supply part 310 and a sensing part 320.

Referring to FIG. 21, the power-supply part 310 includes a built-in battery 311 stably mounted thereon to apply power and the power-supply switch 312 turned on when the lock frame 600 is coupled with the sensing part 320 and turned off when the lock frame 600 is detached from the sensing part 320.

In detail, the power-supply switch 312 may be pressed by a pressure applied by the detachable plate 630 and turn power on when the detachable plate 630 of the lock frame 600, which will be described later, is coupled with the sensing part 320 and may return to an original location thereon and turn the power off due to a removal of the pressure applied by the detachable plate 630 when the detachable plate 630 is detached from the sensing part 320.

In this case, the power-supply part 310 may include a battery port, not shown, to electrically charge the built-in battery 311, which may be formed of 8-celled nickel-hydro battery.

On the other hand, the power-supply part 310 may be formed to turn the power on when the lock frame 600 is coupled with the sensing part 320 and simultaneously, the opening/closing handle 523 of the compression controller 520 is compressed and fastens the opening/closing bar 700 to the first insertion part 500 and to turn the power off when the lock frame 600 is detached from the sensing part 320

FIG. 14 is a cross-sectional view illustrating the lock frame 600 coupled with the sensing part 320 according to an embodiment of the present invention. The sensing part 320 includes, as shown in FIG. 14, a guide groove 321, a plurality of coupling holes 322, and a sealing sensor 324.

The guide groove 321 may be formed to pass through inside the sensing part 320, into which the lock frame may be slidably inserted.

The coupling hole 322 is connected to the guide groove 321, the coupling hole in which the coupling element 323 may be inserted. In this case, the coupling element 323 may be formed of one of a pin, a bolt, and a switch.

The sealing sensor 324 includes one end connected to the coupling element 323 and other end electrically connected to a sealing module 431 of the board 430, which will be described later, when the coupling element 323 is inserted into the coupling hole 322, thereby sensing whether the container is open or closed.

FIG. 11 is a configuration view illustrating the second body unit 400 of the container security apparatus according to an embodiment of the present invention.

The second body unit 400 is coupled with the first body unit 300 internally and includes, as shown in FIG. 11, an antenna part 410 and a board part 420.

The antenna part 410 includes a built-in antenna stably mounted thereon.

FIGS. 16 and 17 are block views illustrating a board 430 according to an embodiment of the present invention.

The board part 420 includes the board 430 stably mounted thereon, and the board 430 includes, as shown in FIG. 16, a sealing module 431, a global positioning system (GPS) module 432, a communication module 433, and a control module 436.

The sealing module 431 is electrically connected to another end of the sealing sensor 324 and transmits information on whether the container is opened or not according to a sensing signal of the sealing sensor 324 to the control module 436.

When a current circulating the lock frame 600 is input/output to/from the sealing module 431 electrically connected to the sealing sensor 324, it is considered as a sealed state and sealing maintenance information may be transmitted to the control module 436. When the lock frame 600 is cut off and a current is not applied, it is considered as a release state and release information may be transmitted to the control module 436.

Figure 22:
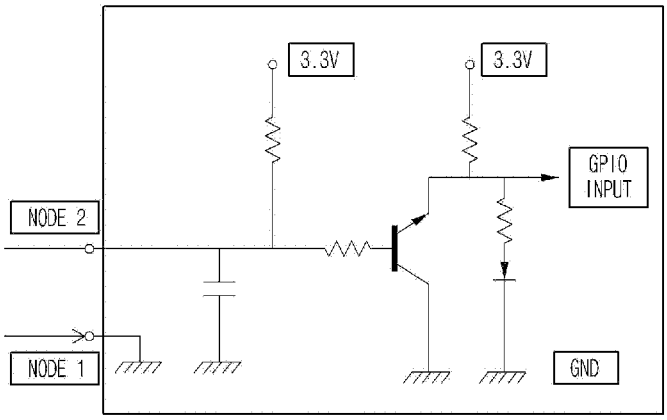
FIG. 22 is a circuit configuration diagram illustrating a sealing module of the board according to an embodiment of the present invention.

FIG. 22 is a circuit diagram illustrating the sealing module 431 of the board 430 according to an embodiment of the present invention.

In detail, when the sealing sensor 324 is electrically connected to a NODE 2 shown in FIG. 22, since a contact point is in contact, a GPIO signal of a central processing unit (CPU) may become HIGH. When the sealing sensor 324 is not electrically connected to the NODE 2, since the contact point is short-circuited, the GPIO signal of the CPU may become LOW.

In this case, the sealing maintenance information may be transmitted when the GPIO signal is HIGH and it is considered as the sealed state, and the release information may be transmitted when the GPIO signal is LOW and it is considered as the release state.

The GPS module 432 senses a real-time location of the container and transmits the location information thereof to the control module 436.

The GPS module 432 may be connected to the control module 436 using a serial interface, may be modulated by applying location information analysis application via universal asynchronous receiver transmitter (UART), and may transmit the location information to the control module 436 periodically, for example, every one minute.

The communication module 433 receives the opening/closing information and the location information from the control module 436 and transmits the same to an administration server.

The communication module 433 may be connected to the control module 436 using a serial interface, may be modulated by applying an Internet communication application via UART such as transmission control protocol/Internet protocol (TCP/IP), and may transmit the opening/closing information and the location information to the administration server via Internet.

In this case, the communication module 433 may be formed of one of code division multiple access (CDMA), wideband code division multiple access (WCDMA), wireless broadband Internet (WiBro), wireless fidelity (WiFi), and global system/standard for mobile communication (GSM) module.

The control module 436 receives the opening/closing information and the location information, transmits the same to the communication module 433, and controls the sealing module 431, the GPS module 432, and the communication module 433.

On the other hand, the board 430 may further include a database (DB) module 434 and a warning module 435, as shown in FIG. 17.

The DB module 434 is controlled by the control module 436 and stores information on the container, such as a transfer path thereof, the number of the container, a license plate number of the container.

The warning module 435 is controlled by the control module 436 and generates and transmits an alarm signal to the control module 436 when the container is deviated from a transfer path thereof stored in the DB module 434 or sealing of the container is released and the sealing module 431 transmits the release information to the control module 436.

In this case, the alarm signal is transmitted from the control module 436 to the communication module 433 and may be transmitted to the administration server in real-time via the communication module 433.

Also, the warning module 435 may generate and transmit an alarm signal to the control module 436 when a present charge capacity of the built-in battery is 25% or less of a maximum charge capacity thereof.

FIGS. 12 and 13 are configuration views illustrating the lock frame 600 of the container security apparatus according to an embodiment of the present invention.

The lock frame 600 may be formed of stainless steel and includes, as shown in FIGS. 12 and 13, a second insertion part 610, flat plates, a detachable plate 630, and a wire 640.

FIG. 20 is a view illustrating the opening/closing bar 700 fastened to the second insertion part 610 according to an embodiment of the present invention.

The second insertion part 610 surrounds another opening/closing bar 700 of the container and is fastened thereto as shown in FIG. 20.

In detail, the second insertion part 610 may be formed in a U shape with a fluent curved portion, inside which a buffering element 611 is provided, in such a way that an impact between the second insertion part 610 and the opening/closing bar is relieved and a grip force may be improved. In this case, the buffering element 611 may be formed of a material capable of improving the grip force by strengthening a frictional force such as rubber.

The flat plate is connected to both ends of the second insertion part 610 in a single body as shown in FIGS. 12 and 13.

In detail, the flat plate may include a first flat plate 621 connected between one end of the second insertion part 610 and the detachable plate 630 in a single body and a second flat plate 622 connected to the first flat plate 621 and another end of the second insertion part 610 in a single body.

FIG. 15 is a partial top view illustrating the detachable plate 630 according to an embodiment of the present invention.

The detachable plate 630 is, as shown in FIG. 15, connected to one of two flat plates 620, for example, the first flat plate 621 and includes a plurality of detachable holes 631 corresponding to coupling holes 322.

The detachable plate 630 is slidably inserted into the guide groove 321 in such a way that the detachable hole 631 corresponds to a location of the coupling hole 322 and is coupled with the sensing part 320 by the coupling element 323.

The wire 640 includes, as shown in FIGS. 12 and 13, one end connected an input detachable hole 631*a* and another end connected to an output detachable hole 631*b* and is provided from the detachable plate 630 to the second flat plate 622.

In detail, the wire 640 is continuously formed inside a top of the lock frame 600 from the detachable plate 630 to the second flat plate 622, from a top to a bottom of the second flat plate 622, and inside a bottom of the lock frame 600 from the second flat plate 622 to the detachable plate 630 in such a way that one end thereof may be connected to the input detachable hole 631*a* and another end thereof may be connected to the output detachable hole 631*b*.

Accordingly, the wire 640 is connected to the coupling element 323 inserted in the detachable hole 631, thereby being electrically connected to the sealing module 431 of the board 430 via the sealing sensor 324 connected to the coupling element 323.

On the other hand, the lock frame 600 may include, as shown in FIG. 12, a wire line formed in a semicircular groove shape therein, into which the wire 640 is inserted, in such a way that the wire 640 is fastened to the lock frame 600.

Also, the lock frame 600 may include, as shown in FIG. 13, a wire groove formed in a circular groove therein, through which the wire 640 passes, in such a way that the wire 640 is fastened to the lock frame 600.

In this case, the wire line and the wire groove may be formed continuously from the detachable plate 630 to the second flat plate 622.

On the other hand, as shown in FIG. 15, on inner circumferential surfaces of the input detachable hole 631*a* and the output detachable hole 631*b*, there may be provided conductive elements 632 electrically connected to the coupling element 323 inserted in the sensing part 320.

Accordingly, the wire 640 provided in the lock frame 600 may be electrically connected to the sealing module 431 of the board 430 via the conductive element 632, the coupling element 323 inserted in the detachable hole 631, and the sealing sensor 324 connected to the coupling element 323.

On the other hand, the container security apparatus according to an embodiment of the present invention may generate an alarm signal by storing data on an illegal opening when illegally opening the container and storing data on situations such as arbitrarily operations and turning off the power.

In this case, when the alarm signal is continuously generated, it is difficult to reuse the container security apparatus. For this, stored data of the container security apparatus may be reset to initialize the container security apparatus.

Figure 23:
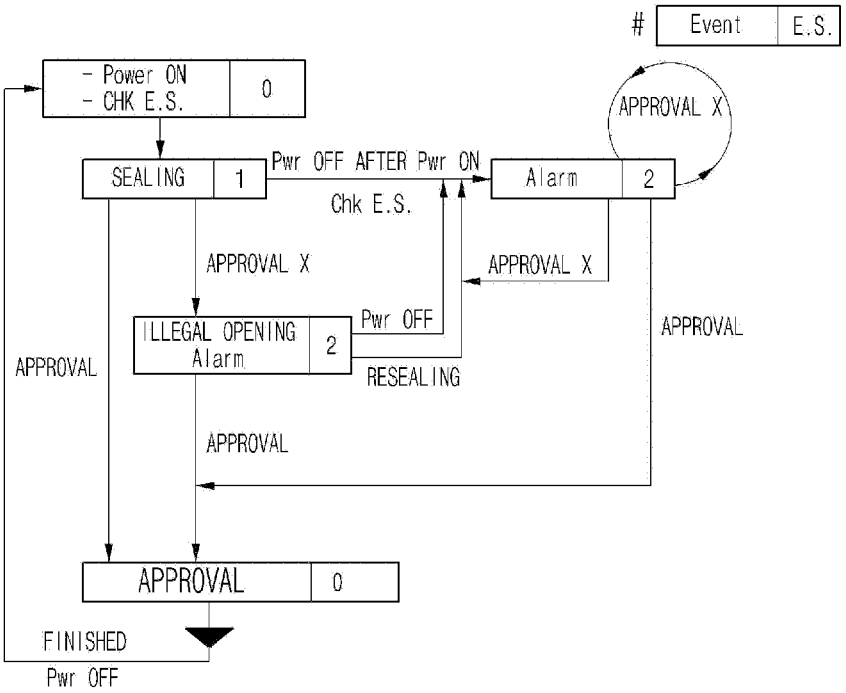
FIG. 23 is a block diagram illustrating an operation of resetting sealing of the container security apparatus according to an embodiment of the present invention.

FIG. 23 is a block diagram illustrating an operation of resetting sealing of the container security apparatus according to an embodiment of the present invention.

The container security apparatus checks the status of the stored data together with booting when power is turned off.

In this case, the check on the status of the stored data may be performed on electrically erasable programmable read-only memory (EEPROM), which is a part of nonvolatile memory, capable of changing a state thereof by using an electric signal.

In detail, when a state of EEPROM (hereinafter, referred to as E.S.) is 0, there is indicated a state of being reset after approval, when E.S. is 1, there is indicated a state of electrical sealing, when E.S. is 2, there is indicated a state of one of containing an illegal opening record and a record of arbitrarily turning off the power and generating an alarm signal.

Accordingly, as shown in FIG. 23, when the power is turned on, a present E. S may become 0 if a previous E.S. is 0, a present E.S. may become 2 if the previous E.S. is 1, and a present E.S. may become 2 if the previous E.S. is 2.

On the contrary, when normally approved, a present E.S. is changed into 0 if a previous E.S is 0, a present E.S. is changed into 0 if a previous E.S. is 1, and a present E.S. is changed into 0 if a previous E.S. is 2. As described above, the container security apparatus is initialized as a reset state, thereby reusing the container security apparatus.

Figure 24:
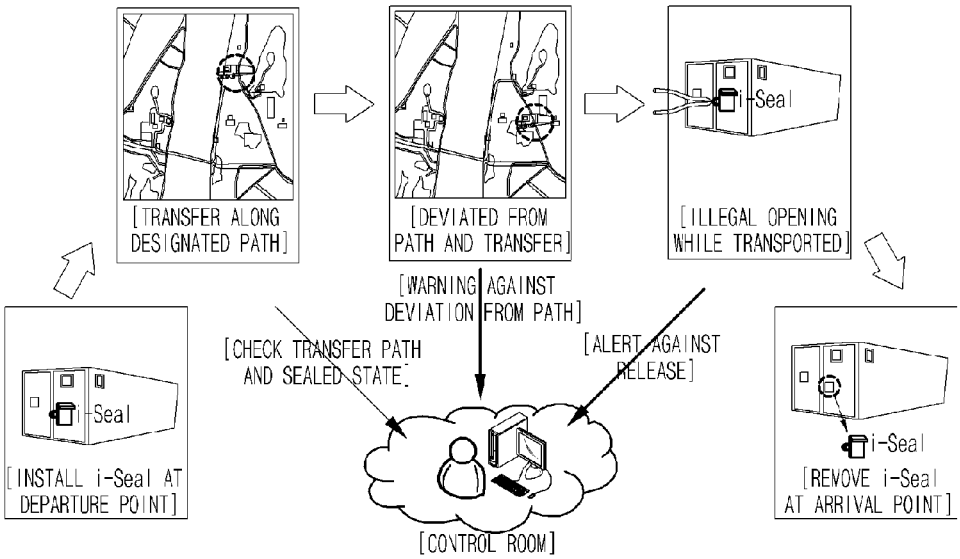
FIG. 24 is a view illustrating the function of the container security apparatus according to an embodiment of the present invention.

FIG. 24 is a view illustrating the function of the container security apparatus according to an embodiment of the present invention.

As described above, as shown in FIG. 24, the container with the container security apparatus according to an embodiment of the present invention attached thereon may check a transfer path and a sealing state thereof in a process of being transported on a designated path. When the container deviates from the designated path, the container security apparatus may transmit a warning against a deviation from the path. Also, when the container is illegally opened, the release information is transmitted to allow a control room to check in real-time.

While the present invention has been particularly shown and described with reference to exemplary embodiments thereof, it will be understood by those skilled in the art that various changes in form and details may be made therein without departing from the spirit and scope of the invention as defined by the appended claims.

INDUSTRIAL APPLICABILITY

According to the present invention, it is sensed whether a container is opened or not and the sensed opening/closing information is transmitted to a remote location to check whether the container is sealed or not, thereby safely transporting the container to be efficiently used in a transportation field.

The invention claimed is:

1. A container security apparatus comprising:

a main cover unit with a display part displaying a present state;

a main frame coupled with the main cover unit internally, comprising a first insertion part surrounding one of both opening/closing bars of a container, formed on one side thereof;

a first body unit coupled with the main frame internally, comprising a power-supply part with a built-in battery for supplying power stably mounted thereon; and a sensing part comprising a guide groove formed penetrating thereinside, a plurality of coupling holes connected to the guide groove, into which a coupling element is inserted, and a sealing sensor whose one end is connected to the coupling element, sensing whether the container is opened or not;

a second body unit coupled with the first body unit internally, comprising an antenna part with a built-in antenna stably mounted thereon; and a board part with a board stably mounted thereon, the board comprising a sealing module electrically connected to another end of the sealing sensor and transmitting the opening/closing information of the container according to a sensing signal of the sealing sensor, a global positioning system (GPS) module sensing a present location of the container in real-time and transmitting the location information, a communication module transmitting the opening/closing information and the location information to an administration server in real-time, and a control module transmitting the opening/closing information and the location information to the communication module and controlling the sealing module, the GPS module, and the communication module; and a lock frame comprising a second insertion part surrounding another opening/closing bar of the container and fastened thereto, flat plates connected to both ends of the second insertion part in a single body, a detachable plate connected to one of the flat plates in a single body, with a plurality of detachable holes formed thereon corresponding to the coupling holes, and slidably inserted into the guide groove of the sensing part and coupled with the sensing part by a coupling element, and wire whose one end is connected to an input detachable hole of the detachable holes and other end is connected to an output detachable hole thereof, wherein sealing maintenance information is transmitted when a current circulating the lock frame is input/output to/from the sealing module electrically connected to the sealing sensor, and wherein the release information is transmitted when the lock frame is cut off and there is no current running therethrough.

2. The apparatus of claim 1, wherein the lock frame comprises a wire line formed thereinside, where the wire is inserted in and fastened thereto.

3. The apparatus of claim 1, wherein the lock frame comprises a wire groove formed thereinside, where the wire passes through and is fastened thereto.

4. The apparatus of claim 1, wherein the lock frame is formed of stainless steel.

5. The apparatus of claim 1, wherein the flat plates comprises:

a first flat plate connected between one end of the second insertion part and the detachable plate in a single body; and a second flat plate connected to another end of the second insertion part in a single body, wherein the wire is continuously formed from the detachable plate to the second flat plate.

6. The apparatus of claim 1, wherein, on inner circumferential surfaces of the input detachable hole and the output detachable hole, there are provided conductive elements, respectively, electrically connected to the coupling element.

7. The apparatus of claim 1, wherein the communication module is formed of one of code division multiple access (CDMA), wideband code division multiple access (WCDMA), wireless broadband Internet (WiBro), wireless fidelity (WiFi), and global system/standard for mobile communication (GSM) module.

8. The apparatus of claim 1, wherein the board further comprises a database (DB) module for storing container information such as a transfer path, a number, and a license plate number of the container.

9. The apparatus of claim 1, wherein the board further comprises a warning module generating and transmitting an alarm signal when the container is deviated from a transfer path thereof or sealing of the container is illegally released.

10. The apparatus of claim 9, further comprising, when the alarm signal is generated, function of resetting data stored when illegally opening the container, arbitrarily operating the container, or turning off the power of the container.

11. The apparatus of claim 9, wherein the warning module generates and transmits the alarm signal when a present charge capacity of the built-in battery is 25% or less of a maximum charge capacity thereof.

12. The apparatus of claim 1, wherein the insertion part comprises:

a sub frame connected to one end of the main frame in a single body and surrounding the opening/closing bar;

a compression controller comprising a shaft whose both ends are fastened to the sub frame externally, a compression cam rotation on an axis of the shaft, and an opening/closing handle connected to the compression cam in a single body;

a tightening element installed inside the sub frame and transferred toward the opening/closing bar by a pressure applied by the compression cam;

a spring section installed on both sides of the shaft and connected from the outside of the sub frame to a top of the tightening element; and a buffering element installed inside between the tightening element and the sub frame and relieving an impact with the opening/closing bar and improving a grip force.

13. The apparatus of claim 12, wherein the spring section comprises:

a plurality of vertical supporters whose one end is vertically connected to the tightening element;

a plurality of springs provided surrounding the outside of the vertical supporters; and a spring stopper provided on other ends of the vertical supporters and connecting the plurality of vertical supporters.

14. The apparatus of claim 1, wherein inside the second insertion part, there is provided a buffering element relieving an impact with the opening/closing bar and improving a grip force.

15. The apparatus according to claim 12, wherein the buffering element is formed of a material capable of improving the grip force by strengthening a frictional force such as rubber.

16. The apparatus of claim 1, wherein the power-supply part comprises a power-supply switch formed on one side thereof, the power-supply switch turned on when the lock frame is coupled with the sensing part and turned off when the lock frame is detached from the sensing part.

17. The apparatus of claim 12, wherein the power-supply part turns on the power when the lock frame is coupled with the sensing part and the opening/closing handle is pressurized and turns off the power when the lock frame is detached from the sensing part and the opening/closing handle is relieved.

18. The apparatus of claim 1, wherein the power-supply part comprises a battery port for electrically charging the built-in battery.

19. The apparatus of claim 1, wherein the coupling element is formed of one of a pin, a bolt, and a switch.

20. The apparatus of claim 1, wherein the display part displays a state whether the power is turned on or off, a state of a residual amount of the battery, a communication state, and a sealed state.

21. The apparatus of claim 1, wherein the main cover unit comprises a sub cover part covering the coupling element and preventing malfunction of the coupling element.

* * * * *